United States Patent [19]

Hofmann

[11] Patent Number: 4,946,169

[45] Date of Patent: Aug. 7, 1990

[54] GAMEBOARD APPARATUS

[76] Inventor: Elsa O. Hofmann, P.O. Box 456, Montclair, N.J. 07042

[21] Appl. No.: 230,006

[22] Filed: Aug. 8, 1988

[51] Int. Cl.[5] ..... A63F 3/00

[52] U.S. Cl. ..... 273/253; 273/256

[58] Field of Search ..... 273/250–254, 273/256

[56] References Cited

U.S. PATENT DOCUMENTS

| | | | |
|---|---|---|---|
| 2,026,082 | 12/1935 | Darrow | 273/256 |
| 4,109,918 | 8/1978 | Mele et al. | 273/256 |
| 4504,061 | 3/1985 | Michel | 273/250 |

FOREIGN PATENT DOCUMENTS

| | | | |
|---|---|---|---|
| 8601736 | 3/1986 | Australia | 273/253 |
| 1229005 | 9/1960 | France | 273/250 |
| 1015952 | 1/1966 | United Kingdom | 273/253 |
| 2139510 | 10/1984 | United Kingdom | 273/253 |

*Primary Examiner*—William H. Grieb
*Assistant Examiner*—Benjamin Layno

[57] ABSTRACT

A gameboard apparatus picturing an advanced, economic, technological civilization throughout the solar system and beyond, a path of spaceships containing many contingency circumstances interspersed between man-made, unpurchaseable property containing many contingency circumstance, and eleven major types of purchaseable man-made properties containing many contingency circumstances. The indicia on color-coded leases describes the internal, external, vertical and horizontal development of real estate in over thirty ways, four decks of cards, Speed of Light Years Utility Service Card and Speed of Light Years Ticket Tokens color coded to work in conjunction with the path of spaceships which are path of the continuous open route with a starting point from Earth, the entire game being described by a set of rules.

4 Claims, 9 Drawing Sheets

| | | |
|---|---|---|
| FIG. 1A | FIG. 1B | FIG. 1C |
| FIG. 1D | FIG. 1E | FIG. 1F |

SHEET 1

SHEET 2

FIG. IC
SHEET 3
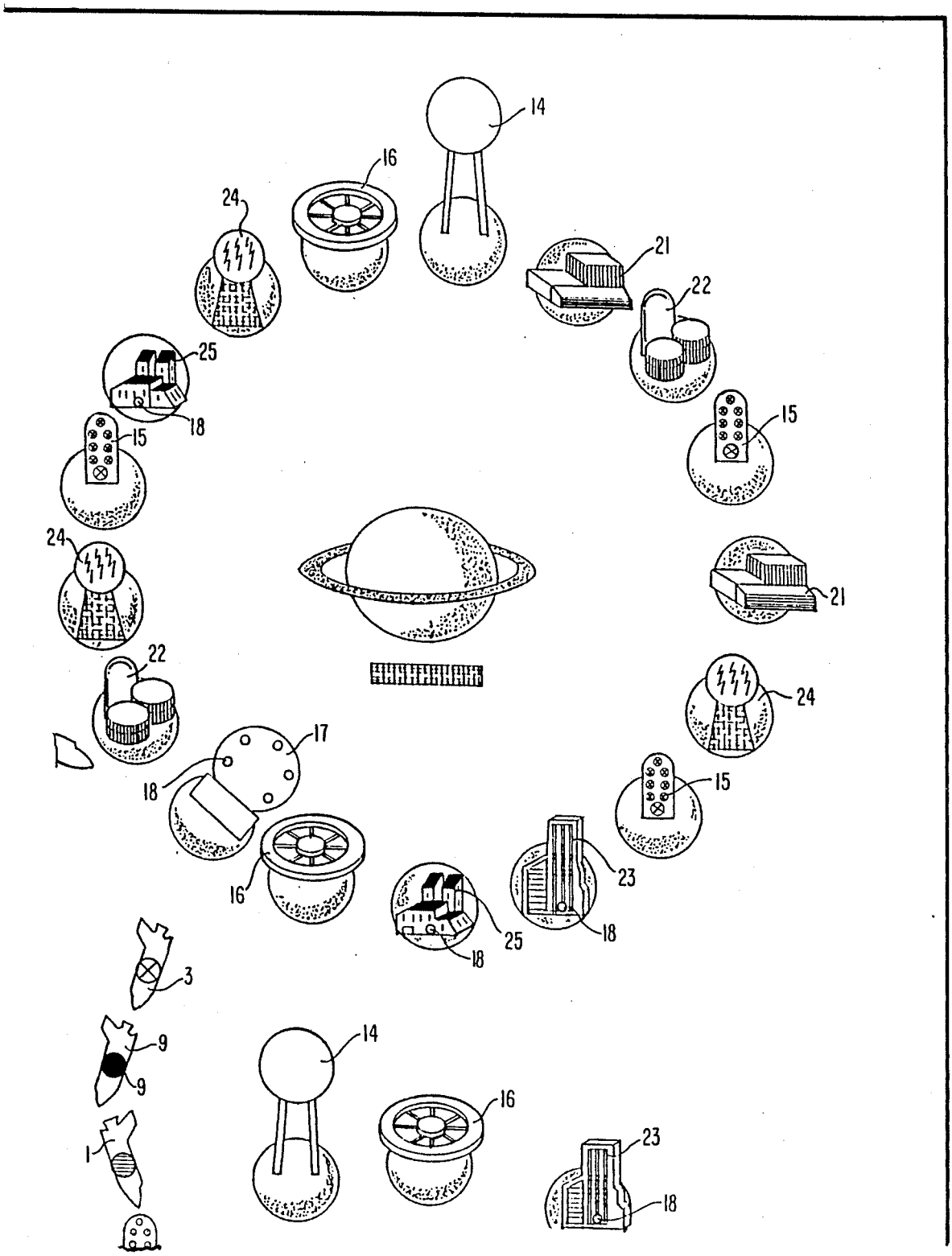

SHEET 4

SHEET 5

SHEET 6

FIG. 16

SPEED OF LIGHT YEARS TICKET TOKEN

YOU HAVE LANDED ON THE BLUE DOT SPACESHIP. JET AHEAD 5 SPACES WITH THE SPEED OF LIGHT. CHECK UTILITY CARD.

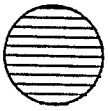

FIG. 17

SPEED OF LIGHT YEARS TICKET TOKEN

YOU HAVE LANDED ON THE GREEN DOT SPACESHIP. JET SIDEWAYS TO THE OPPOSITE CELESTIAL OBJECT TO WHERE YOU HAVE NOW LANDED WITH A SPEED FASTER THAN LIGHT. CHECK UTILITY CARD.

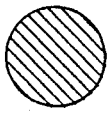

FIG. 18

SPEED OF LIGHT YEARS TICKET TOKEN

YOU HAVE LANDED ON THE PURPLE DOT SPACESHIP. JET BACK THREE SPACES WITH THE SPEED OF ANTI-LIGHT. CHECK UTILITY CARD.

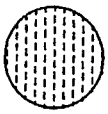

FIG. 19

SPEED OF LIGHT YEARS TICKET TOKEN

YOU HAVE LANDED ON THE RED DOT SPACESHIP. JET AHEAD 3 SPACES WITH THE SPEED OF SUPER-CONDUCTIVITY. CHECK UTILITY CARD.

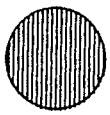

FIG. 20

SPEED OF LIGHT YEARS TICKET TOKEN

YOU ARE LOST IN SPACE WHEN LANDING ON A PINK DOT SPACESHIP. CHECK UTILITY CARD.

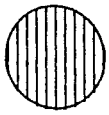

FIG. 21

SPEED OF LIGHT YEARS UTILITY SERVICE
PAY WORLD BANK INCORPORATED ACCORDING TO THE AMOUNTS LISTED WHENEVER LANDING ON A SPEED OF LIGHT YEARS DOTTED SPACESHIP.

AMOUNTS OF THE NATURAL RESOURCE USED.

| | WATER-GALLONS | ELECTRICITY-KWHR | FUEL-GALLONS | PRICE CHARGED |
|---|---|---|---|---|
| SPEED OF LIGHT | 1,000 | 4,000 | 250 | $ 5,000. |
| SPEED FASTER THAN LIGHT | 2,000 | 8,000 | 500 | $10,000. |
| SPEED OF ANTI-LIGHT | 4,000 | 16,000 | 1,000 | $20,000. |
| SPEED OF SUPER CONDUCTIVITY | 8,000 | 18,000 | 2,000 | $30,000. |
| LOST IN SPACE | 16,000 | 36,000 | 4,000 | $60,000. |

PLAYERS ARE COMPELLED TO PAY THESE FEES TO WORLD BANK, INC. EACH TIME THEY LAND ON A DOTTED SPACESHIP. THE DOTTED COLOR OF THE DOTTED SPACESHIP INDICATES THE DIRECTION THE SPEED OF LIGHT YEARS TAKES THE SPACESHIP. THE SPEED TRAVELLED AND THE DIRECTION ARE INDICATED ON THE SPEED OF LIGHT YEARS TICKET TOKEN WHICH PLAYERS MUST CHECK AND FOLLOW BEFORE PAYING THE FEE.

GAMEBOARD APPARATUS

BACKGROUND OF INVENTION

Imagine you are living in the 22nd century and for over a thousand years Earth people have been dwelling throughout the solar system and beyond. For over a thousand years people have been journeying away from planet Earth in search of a younger star and solar system and building communities along the way.

SUMMARY OF INVENTION

The present invention is a game of high entertainment which gives players the unique experience of what it may be like to live in peaceful communities of advanced, economic, technological civilizations in outer space in a future century.

Generally speaking, this game consists of a playing field having marked thereon a continuous path of spaceships interspersed between unpurchaseable, man-made property containing many contingencies some of which are based on indicia of playing cards called Communication Satellite Cards, Space Station Message Cards, Cosmos University Cards and Taxie Shuttle Cards, and some of which are based on directions in the rules or both. There is a continuous, open path of spaceships between purchaseable, man-made property founded on potentially habitable planets, moons, asteroids and a galaxy and unpurchaseable man-made property containing many contingency circumstances. The man-made property is of eleven major types which can be developed in over thirty ways, internally, externally, vertically and horizontally based on indicia listed in the rules and on color coded leases which define where the real estate is located on the playing field.

The rules state players may begin to purchase leases the moment they land on a planet, moon, asteroid or galaxy containing purchaseable, man-made property which has not already been purchased by another player or team each time it is their turn. The leases state that before players own Hotels, Space Stations, Condominiums, Animal and Dairy Farms, Manufacturing Plants, Mining Sites, Shopping Malls and Spaceports (vacation resorts), they must pay World Bank, Incorporated a docking fee for docking there. Once a player owns the lease for the property, they are paid the docking fee. Upon development of the lease, rents are charged in hierarchical order listed on the lease whether that development be internal, external, horizontal or vertical. Only in the case of Mining Sites, Manufacturing Plants and Space Stations are monopolies formed not only by ownership of the same type of property, but in the same color coded location as well. All other types of real estate ownership will be a mix of color coded locations for the same kind of property which players may make monopolies.

Water Storage Tanks, Electrical Power Plants and Fuel Stations increase fees for water, electricity and fuel by the number of these properties a player owns. Before private ownership of these utilities, World Bank, Inc. is paid for the use of water, electricity and fuel each time a player lands on a planet or moon containing a Water Storage Tank, Electric Power Plant or Fuel Station. The eleven different types of color-coded leases will be described later.

BRIEF DESCRIPTION OF THE DRAWINGS

FIG. 1 illustrate the playing board being divided into six section.

FIGS. 1A–1F illustrates the details of the six sections of the playing board.

FIGS. 16–20 illustrate Speed Of Light Year Ticket Tokens.

FIG. 21 illustrates a Speed Of Light Years Utility Service Card.

DETAILED DESCRIPTION OF THE PRESENT INVENTION

Figures 1, 1A:
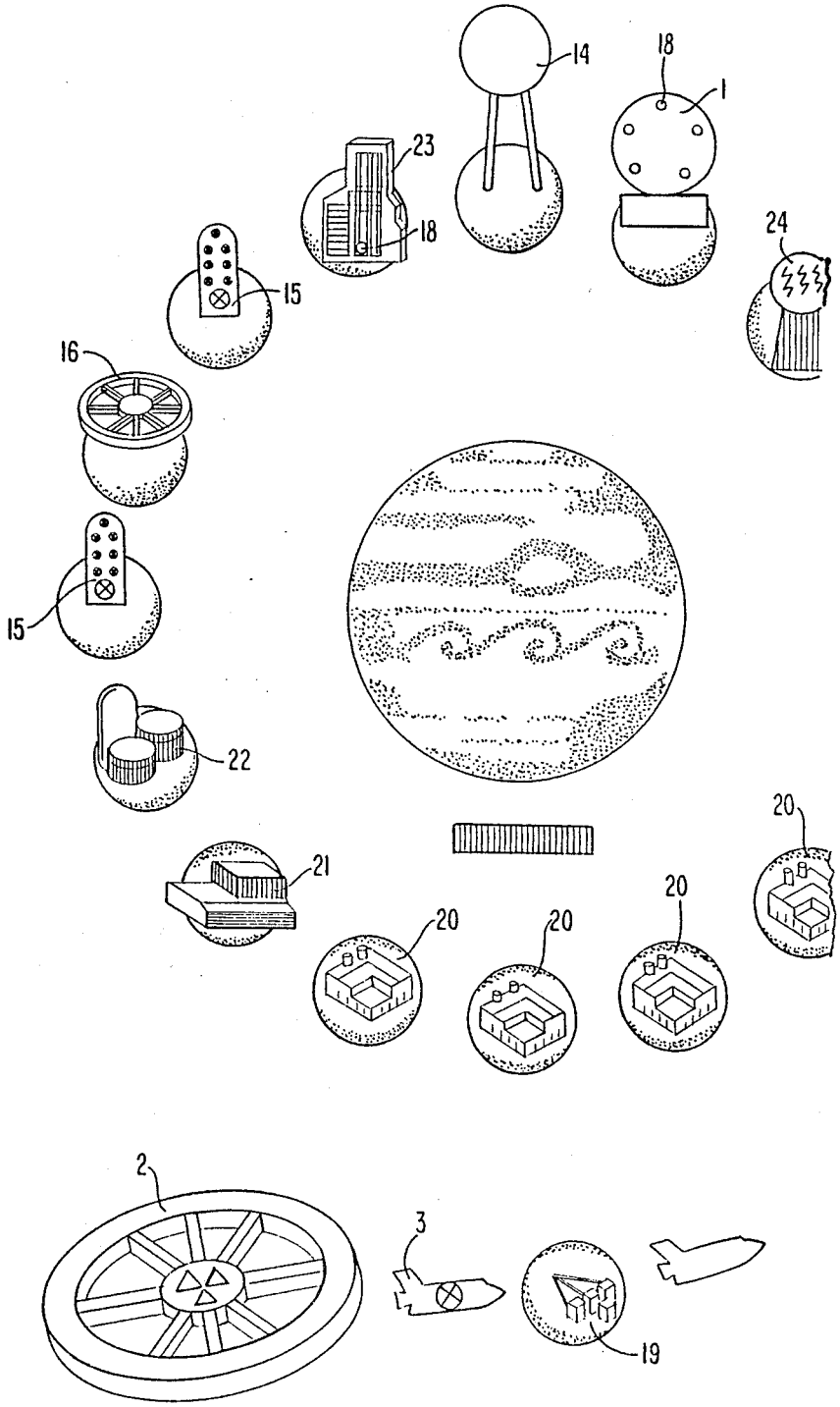

Some of the spaceships along the path of spaceships are color coded to indicate a contingency circumstance. These color coded spaceships work in conjunction with Speed of Light Years Ticket Tokens illustrated from FIG. 16 to FIG. 20 and a Speed of Light Years Utility Service Card illustrated at FIG. 21.

The Speed of Light Years Ticket Tokens are of five different colors each indicating a different type of speed and direction a player's spaceship must take. These colors are: blue, green, purple, red and pink. When a player lands on a color-coded spaceship it states in the rules they are compelled to select a Speed of Light Years Ticket Token and follow its direction after which they are told to check the Speed of Light Years Utility Service Card and pay a fee for the amount of water, electricity and fuel they used for the type of speed, direction or being lost in space their spaceship has experience.

FIG. 16 states: You have landed on the blue dot spaceship, Jet ahead 5 spaces with the speed of light. Check utility chard. The Utility Service Card states that at the speed of light the player has used 1,000 gallons of water, 4,000 killowat hours of electricity and 250 gallons of fuel and must pay World Bank, Inc. $5,000. The blue dot spaceship is number 1 on the playing field.

FIG. 17 illustrates the green dot speed of light years ticket token. It states: You have landed on the green dot spaceship. Jet sideways to the opposite celestial object to where you have now landed with a speed faster than light. Check Utility Card. At FIG. 21, the Utility Service Card states that at the speed faster than light a player used 2,000 gallons of water, 8,000 killowat hours of electricity and 500 gallons of fuel and the player must pay World Bank Inc. $10,000. The green dot spaceship is No. 5 on the playing field.

FIG. 18 illustrates the purple dot Speed of Light Years Ticket Token. It states: You have landed on the purple dot spaceship. Jet back three spaces with the speed of anti-light. Check Utility Card. On FIG. 21, the Utility Service Card states that at the speed of anti-light players use 2,000 gallons of water, 16,000 killowat hours of electricity and 1,000 gallons of fuel and must pay World Bank, Inc. $20,000. The purple dot spaceship is No. 11 on the playing field.

FIG. 19 illustrates the red dot Speed of Light Years Ticket Token. It states: You have landed on the red dot spaceship. Jet ahead 3 spaces with the speed of superconductivity. Check Utility Card. On FIG. 21 it states on the utility service card that at the speed of super conductivity a player used 8,000 gallons of water, 18 killowat hours of electricity and 2,000 gallons of fuel and must pay World Bank, Inc. $30,000. The red dot spaceship is No. 4 on the playing field.

FIG. 20 illustrates the pink dot Speed of Light Years Ticket Token. It states: You are lost in space when landing on a pink dot spaceship. Check utility card. On FIG. 21, The Speed of Light Years Utility Service Card states that when lost in space a player used 16,000 gallons of water, 36,000 killowat hours of electricity and 4,000 gallons of fuel and must pay World Bank, Inc. $60,000. The pink dot spaceship is No. 26 on the playing field.

Certain spaceships along the path of spaceships are marked with an X enclosed in a circle. These spaceships are No. 3 on the playing field and symbolize the player is compelled to select a Taxie Shuttle Card from the top of the face down deck as stated in the rules. As there are only fourteen of these cards and three spaceships on the path containing its symbol, the various places named will be visited more often than other places making more revenue for the owners of these leases.

No. 9 on the playing field represents the black dot spaceship. Each black dot spaceship contains a number beside it from 6 to 10. The black dot spaceship represents the pull of gravity of the nearest planet. It states in the rules that in order to break through the pull of gravity, players must roll a number higher than the number listed on the black dot spaceship on their next turn or turns.

Another contingency circumstance involving the path of spaceships states in the rules: when four or less players compete, each player may select at least four spaceships to advance around the gameboard. Players may than add the contingency circumstance of a laser beam blockade. When two spaceships belonging to the same player land on the same spaceship along the path of spaceships a blockade is formed and no other spaceships may pass by, not even that players own. If two spaceships belonging to two different players land on the same spaceship, war is declared by the landing player stating, "I challenge you." The players then roll the dice and the highest roller may remain on the space. The lowest roller must move to the Black Hole.

It states in the rules an alternate style of the game may be played by making the purchase of leases an open market and not guided by the listed prices on the leases. When any player lands on a property that has not been purchased by another player, the Banker auctions the lease for that property by asking interested players to put in a bid. This may be done by players raising their hand and taking turns to make a bid or it may be done by players submitting a bid on a piece of paper and initialing it. The banker would then read off the bids and the highest bidder would be entitled to purchase the lease. If that player doesn't have the cash, the next highest player would be the next in line to make the purchase.

The rules state players collect script money when landing on Cosmos Bank. Cosmos Bank is No. 6 on the playing field. Players collect money when they cross the Van Allen Radiation Belts, No. 27 on the playing field. Players also collect money when they land on or pass Earth, No. 13 on the playing field.

The rules state the Black Hole may function as a jackpot, tunnel back to Earth or a trap. The Black Hole functions as a jackpot when players decide to place some of the money won at the Cosmos Bank at the Black Hole for players who become trapped there to collect. It becomes a trap when players land there and do not have a saved release card from the Space Station Message deck illustrated on FIG. 5 or the Communication Satellite deck illustrated on FIG. 4. In the latter case, the player must roll doubles on their next turn or turns.

When players have a saved release card from the Space Station Message deck or Communication deck, the Black Hole becomes a tunnel back to Earth.

Figure 4:
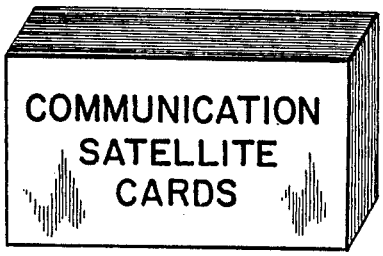
FIG. 4 illustrates the deck of Communication Satellite Cards.
Figure 5:
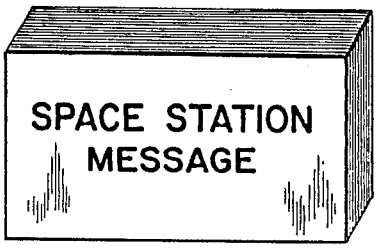
FIG. 5 illustrates the deck of Space Station Message Cards.

Through imaginative indicia on the 130 directives called Space Station Message and Communication Satellite cards illustrated on FIG. 4 and FIG. 5, players enjoy many adventures, duties, win prizes for exemplary performance in their "chosen professions," explore places never seen before and carry out pursuits never experienced by Earth dwelling people. These two decks of cards are split in two, shuffled and placed face down at the four locations bearing the two named Space Station Message and the two places named Communication Satellite No. 6 and No. 7 on the playing field. As stated in the rules, players are compelled to select a card from the top of these decks and follow the directions when landing on these four locations.

Cosmos University is No. 2 on the playing field. As stated in the rules, when players land on Cosmos University, they are compelled to select a card from the top of the question deck and try to answer the question. If the player can answer the question, they win a money prize. There is no penalty for not being able to answer the question. The questions deal with science, philosophy and space from ancient Greek times to the present.

Alpha Polis is No. 12 on the playing field. When players land on Alpha Polis, free space city, they enjoy a free vacation. Alpha Polis offers players many advantages such as: Table tennis, swimming at zero-g, free repair for spaceships, free refueling, a theater, a video and film room, a library of all the great books of all the great minds that have ever been written, a spa and gym for workouts, free lodging, space food made of spices and herbs which enables players to make astral visits throughout the universe and a giant telescope to view the universe.

Figure 6:
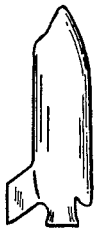
FIG. 6 illustrates a game piece representing a player.
Figure 7:
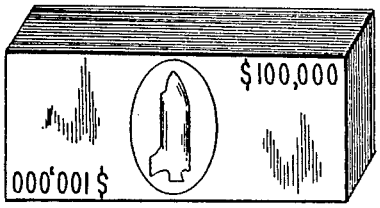
FIG. 7 illustrates script money.
Figure 8:
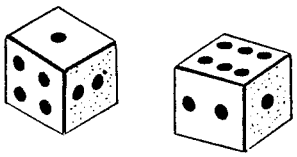
FIG. 8 illustrates dice used in playing the game.
Figure 9:
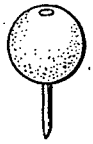
FIGS. 9–15 illustrate various playing pieces to be placed on the playing board.
Figure 10:
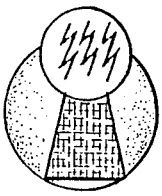
Figure 12:
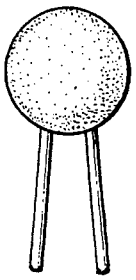
Figure 13:
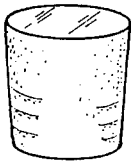
Figure 14:
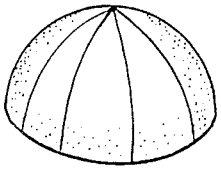
Figure 15:
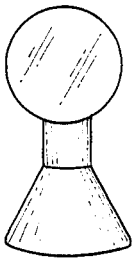

The remaining pieces of equipment for playing the game are script money illustrated at FIG. 7, gamepieces representing a player illustrated at FIG. 6, dice illustrated at FIG. 8, tokens to develop the real estate illustrated at FIG. FIG. 9, FIG. 13 and FIG. 14 or mark it as having been sold in the case of Water Storage Tanks illustrated at FIG. 12, Electric Power Plants illustrated at FIG. 10 and Fuel Stations illustrated at FIG. 15.

The rules state at the start of the game, players roll the dice and the highest roller becomes banker and deals out the cash to the players. Each player is given: 10-$100, $1,000, $500, $5,000, $20,000, $100,000, $1,000,000, and two each: $50,000, $5,000,000 and $50,000,000. The banker takes the responsibility for building tokens and leases. If many players compete, one of the players sole function may be that of banker.

The players roll the dice again and the highest roller goes first and gets first choice of a spaceship. The other players follow in clockwise order. Spaceships are placed on Earth, roll the dice once again in turn and the game begins. The winner is the last player on the gameboard or the player with the most cash or property value at the end of an agreed upon time.

DETAILED DESCRIPTION OF THE PRESENT INVENTION

FIG. 1A to FIG. 1F illustrates the playing board according to a preferred embodiment of the present invention. A designated, continuous path of movement is provided on the playing surface on which players may move a gamepiece or game pieces from the starting point of Earth throughout the entire solar system and beyond in accordance with instructions in the rules. There are 70 pictured places for players to visit. Sixty one of these contain man-made purchaseable property of eleven types.

FIG. 1A No. 2 illustrates Cosmos University. At this location players are compelled to select a question card from the top of the question face up deck and try to answer its question for a money prize.

FIG. 1A, No. 3 illustrates the symbol for Taxie Shuttle Cards. Whenever a player lands on a spaceship marked with the symbol of an X enclosed in a circle, they are compelled to select a Taxie Shuttle Card from the top of the face down deck and follow its directions.

Figure 1B:
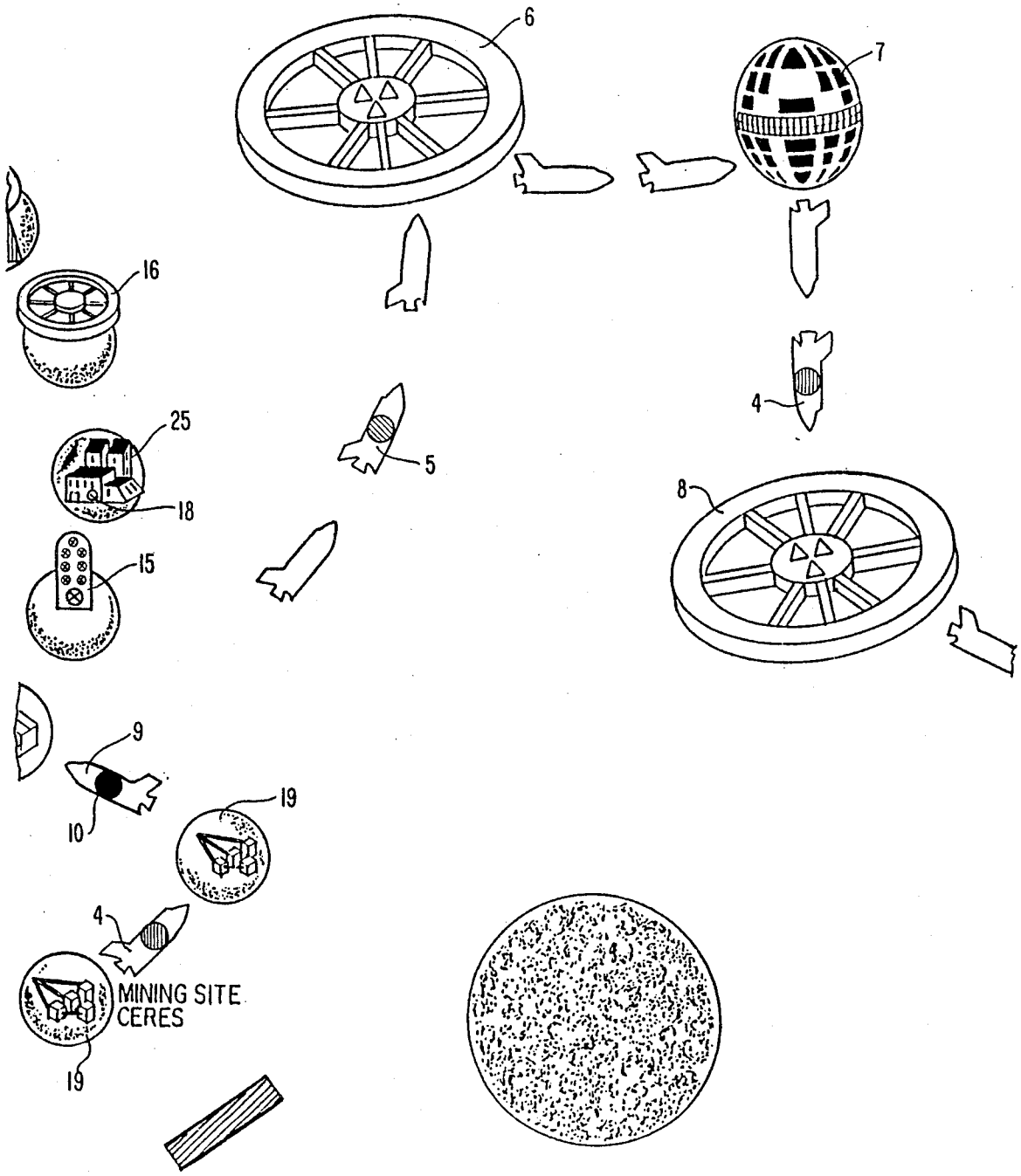

FIG. 1A and FIG. 1B illustrates the location of the asteroid belt. This location is color coded brown. Mining Sites are located on Pallas, Ceres and Vesta. Mining Sites are improved by adding mass drivers, super conductor rails, rail cars and a power plant. This is an example of external real estate development. Table 8 illustrates a lease for a Mining Site. Mining Sites are No. 19 on the playing field.

FIG. 1B illustrates a red, color coded spaceship, No. 4, and a green color coded spaceship, No. 5.

FIG. 1A, No. 20 illustrates Manufacturing Plants. Lease for manufacturing plants is illustrated on Table 4.

FIG. 1A, No. 21 illustrates a shopping mall. A Lease for shopping malls is illustrated on Table 6.

FIG. 1A, No. 22 illustrates a Dairy and Animal Farm. A Lease for a Dairy and Animal Farm is illustrated on Table 5.

FIG. 1A, No. 15 illustrates a fuel station. A Lease for a fuel station is illustrated on Table 10. Once a player purchases the Lease for a fuel station, it may be marked as sold by placing the marker on the location shown at FIG. 15.

Figure 11:
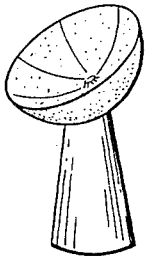

FIG. 1A, No. 16 illustrates a Space Station. A Lease for Space Stations is illustrated on Table 2. The tokens with which to develop Space Stations are shown at FIG. 14, a housing dome and an agriculture dome, FIG. 10, a fuel station, FIG. 13 a telescope and FIG. 9 which may be used as a token for various illustrations of real estate development. FIG. 11 illustrates a communication satellite.

FIG. 1A, No. 23 illustrates a hotel. No. 18 illustrates a hole in the playing field. Table 5 illustrates a Lease for a hotel. FIG. 9 illustrates a token for developing hotels. The prong end of the piece fits into a hole on the playing field. Further rooms are added by putting the remaining added rooms into the hole on top of the globe shaped piece. In the manner of stacking the rooms one on top of the other. This is an example of verticle real estate development.

FIG. 1A, No. 14 illustrates a water storage tank. A Lease for a water storage tank is illustrated on Table 11. Once a player purchases the Lease for a water storage tank, it may be marked as sold by the player placing the marker FIG. 12 on the location.

FIG. 1A, No. 17 illustrates a spaceport, vacation resort. No. 18 illustrates a hole in the spaceport. Table 3 illustrates a Lease for a spaceport. FIG. 9 is a marker that may be used as a development game piece. Its prong end fits into the playing fields No. 18. This is an example of external, internal and Horizontal development.

FIG. 1A No. 24 illustrates an electric power plant. Table 1 illustrates a Lease for an electric power plant. Once a player purchases the Lease for an electric power plant, it may be marked as sold by placing the token No. 10 on the location.

FIG. 1B, No. 25 illustrates a condominium. No. 18 illustrates a hole on the playing field. FIG. 9 illustrates a playing piece with a prong end which may be fitted into the hole No. 18. As players purchase apartments in developing the Lease, they may be stacked by placing the remaining apartments prong end into the hole on top of the marker. This is another example of internal external and verticle development. Table 7 illustrates a Lease for a condominium.

Figure 1D:
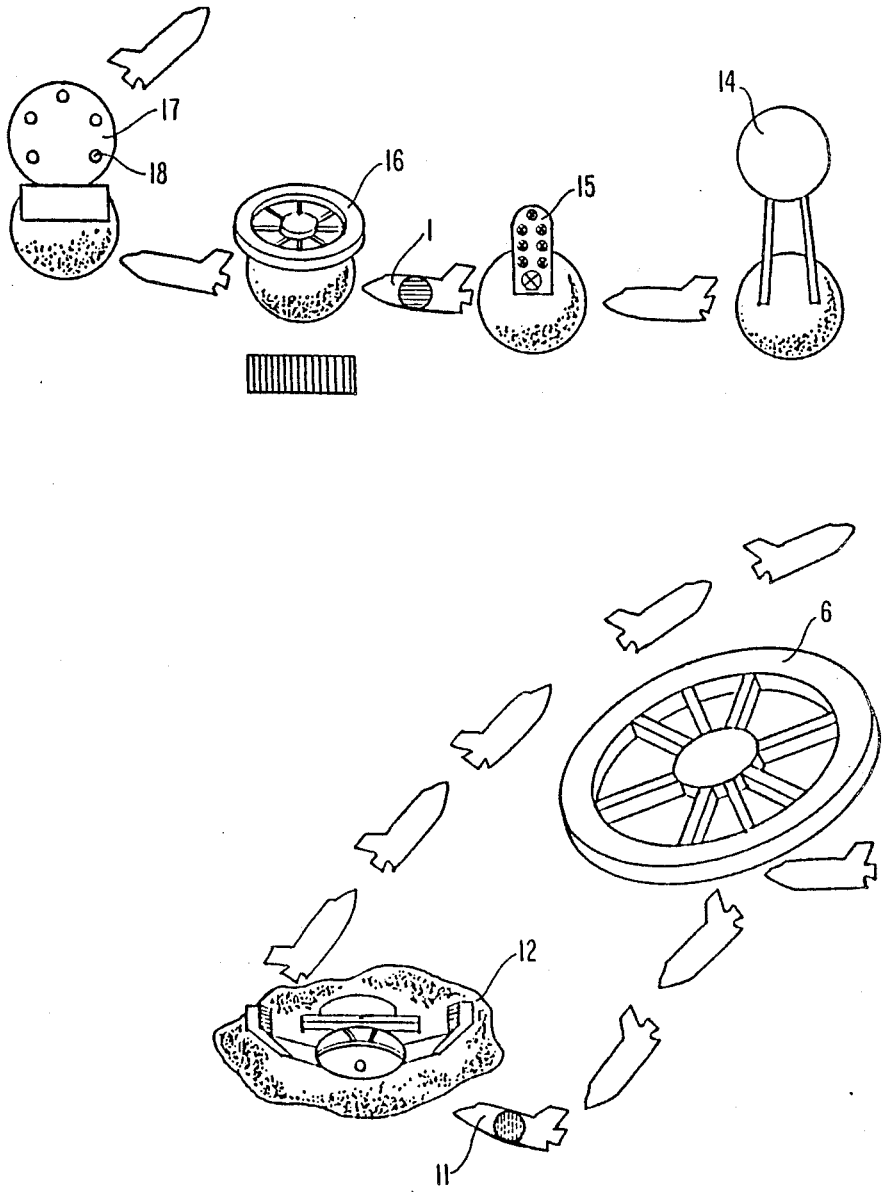

FIG. 1B, No. 6 illustrates a space station message. At this location players pick a directive from the top of the face down deck illustrated at FIG. No. 5 and follow its directions. FIG. 1D, No. 6 is the location of the second space station message.

FIG. 1B, No. 7 illustrates a Communication Satellite. FIG. 4 illustrates the deck of cards placed at this location before the game begins. A second, communication satellite is located on FIG. 1F, No. 7.

FIG. 1B, No. 8 illustrates Cosmos Bank. At this location players collect money when landing here.

The purchaseable real estate located around Jupiter on its moons is color coded red on all the Leases.

FIG. 1C illustrates the yellow color coded zone on the playing field. It contains the same real estate illustrated in the red color coded zone.

Figure 1E:
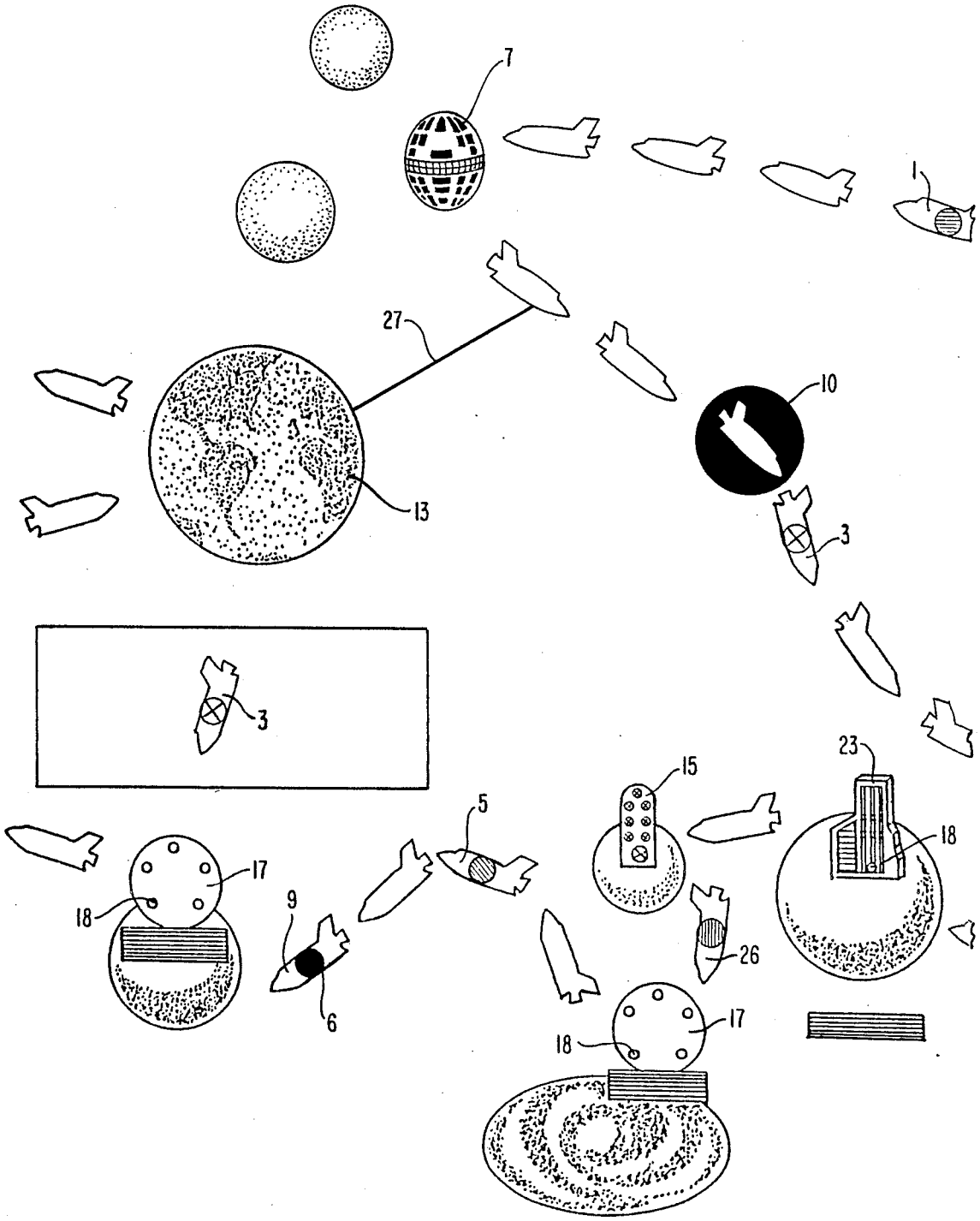
Figure 1F:
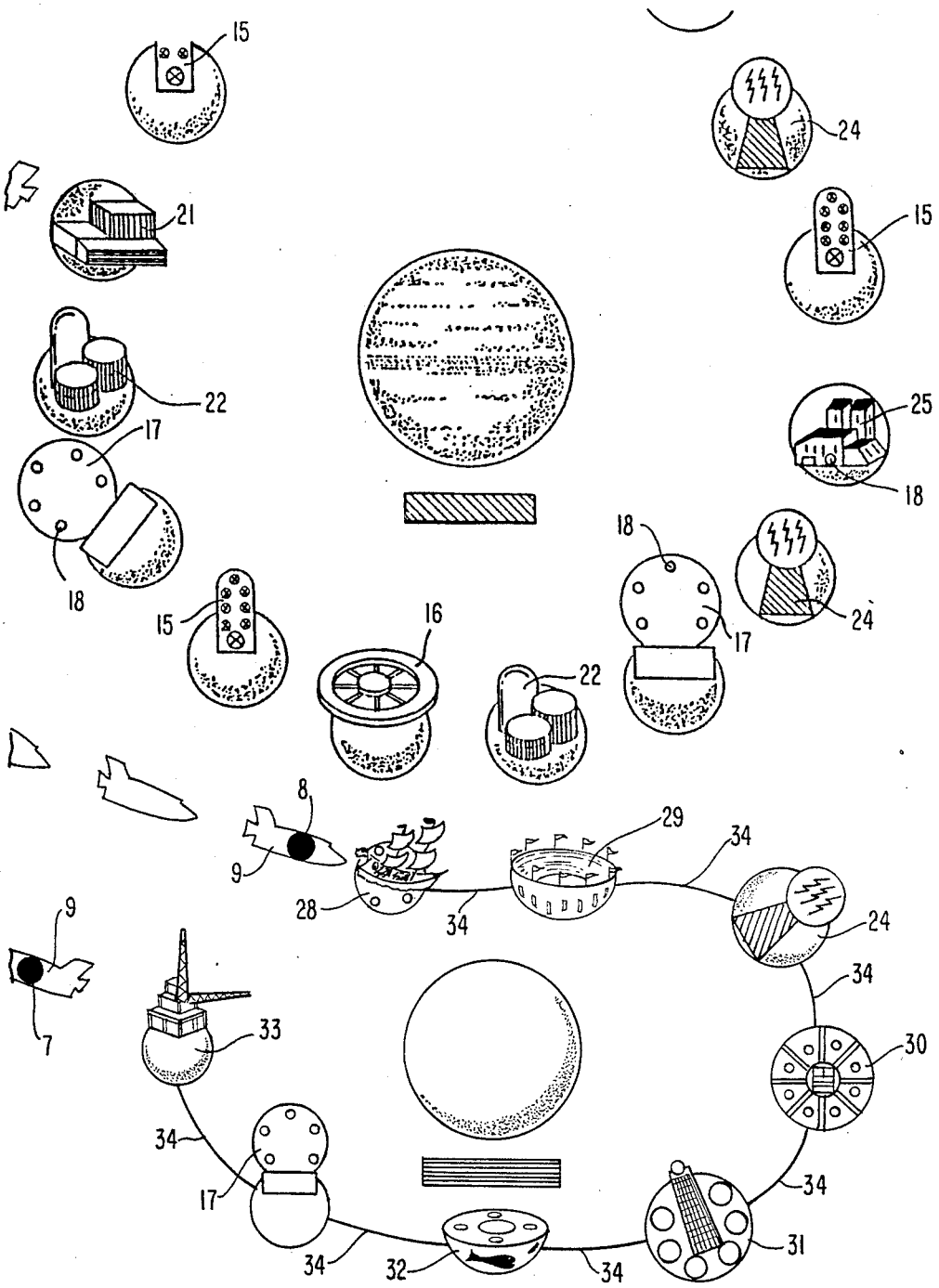

On leaving the yellow color coded zone, players will enter the green color coded zone. It contains the same kinds of real estate already mentioned in the red and yellow color coded zone. It also contains No. 10, the Black Hole. The function of the Black Hole was described in the summary. The beginning of the blue color coded zone is also located here and extends from: FIG. 1F to FIG. 1E. FIG. 1F, No. 11 illustrates a purple dot spaceship. The color coded spaceships were described in the summary.

Figure 2:
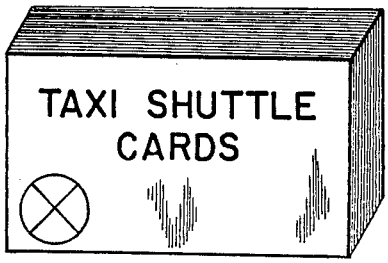
FIG. 2 illustrates the deck of Taxi Shuttle Cards.
Figure 3:
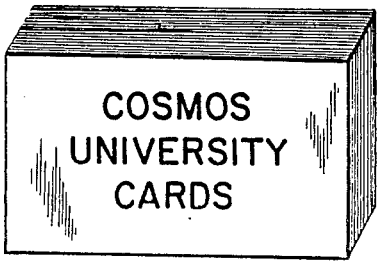
FIG. 3 illustrates the deck of Cosmos University Cards.

FIG. 1E, No. 27 illustrates the Van Allen Radiation Belts. When players cross over the radiation belt, they collect a money prize. No. 26 illustrates the pink dot spaceship already described in the summary. No. 3 where the words Taxie Shuttle are written illustrates where the Taxie Shuttle Cards are placed before the game begins. Taxie Shuttle Cards are illustrated at FIG. 2.

FIG. 1E, No. 13 illustrates the Earth. It is where players place the tokens representing them at the start of the game. Players also collect money when landing or passing the Earth as the move along the continuous, open route.

FIG. 1D, No. 12 illustrates Alpha Polis, free space city already described in the summary. The trademark SPACE is also illustrated on this sheet. This page marks both the end and the beginning of the journey. Above is Earth's moon followed by Mars and its satellites. The purchaseable, man-made property illustrated here is color coded pink on the Leases. These purchaseable properties in the pink color zone mark the start of the journey from planet Earth.

It is understood that players cannot land on the Sun, Venus, Mercury, Jupiter, Saturn, Uranus and Neptune as these places are known to be uninhabitable and not capable of having real estate built on them and are illustrated on the playing field only as part of the Solar System.

When purchasing space property, a player or corporation of players must follow the order listed on the lease.

To get the price of each game piece, multiply a throw of the dice by $9,000.00. If a player owns all the hotels, regardless of which planetary-satellite-group it is located, they may double the rent according to the development of the lease. Players may mortgage their property at half price to World Bank, Inc.

Cosmos University cards must be selected by a player each time a player lands on this contingency space. A description of the indicia on these cards follows.

COSMOS UNIVERSITY CARDS

For $100 state what the perfect number is and what is its Greek Name?
10 or tetraktys 1+2+3'4=10 or the divine fourfoldness from the Pythagoreans.

For $100 state how Anaximander divided the cosmos surrounding the Earth?
1. Air and clouds. 2. Stars. 3. Moon. 4. Sun. 5. Region of Fire.

For $100 tell what a parsec is?
A parsec is the distance at which the Earth and Sun would appear to be 1 second or arc apart.

For $1000 state how many light years across a cluster of galaxies can be?
Many 10s of millions of light years.

For $1000 state what holds galaxies together?
Gravity.

For $500 state whether or not galaxies exist alone?
Rarely. They usually exist in groups of 2 or 3 to a 1000 or more.

For $1000 state how many years it takes our Galaxy to revolve once around its axis?
About 100,000,000 years.

For $1,000 state why the information we receive from galaxies is old news?
Because it takes a billion years or more for their light to reach us. So todays information is a billion years old.

For $500 state what clusters of galaxies are called?
Superclusters.

For $500 tell what may cause R Cor Bor stars to seem to disappear?
As ejected gas recedes from the star, it grows colder. At some temperature carbon atoms condense to make soot. The soot powder makes a veil and obscures the light of the star.

For $2,000,000 describe the cause of a white dwarf nova?
A stream of gas pours from the cool star, hits the disk which encircles the white dwarf star like a crash barrier and a hot spot is created at point of impact making the white dwarf star increase its magnitude or light output more than a hundredfold. Then over a period of one to three weeks, the star drops back to its original brightness.

For $500 tell if stars exist anywhere else besides galaxies?
No. Stars only exists in galaxies.

For $5,000 tell what a pulsating star is?
It is a period range from 1 to 50 days when its light curve goes from 4th to 5th magnitude.

For $500 state what kind of a star is our Sun?
A yellow dwarf.

For $1,000 give another name for pulsating stars?
Cephedis.

For $1,000,000 state how many known stars like R Coronae Borealis are in the Universe and what are they called?
There are 29 known and they are called R Cor Bor stars.

For $2,000 state what kind of star Delta Cephei is?
A pulsating star.

For $20,000 state what it is that 61 Cygni and M67 have in common as far as age is concerned?
At 5 billion years, they may be the oldest living Galactic fossils in rotation.

For $5,000 state what an annulus is?
A thin ring of sunlight around the Moon during an eclipse.

For $500 tell the name of our closest neighbor? The Moon.

For $500 tell why you can't fall of the Earth? Because the Earth's gravity pulls everything toward the center.

For $500 state the name of the arm that our solar system is located in the Milky Way Galaxy?
Orion arm.

For $500 tell why it gets dark at night? Because the Earth is spherical and only half of it faces the Sun at a time.

For $500 state near what constellation the south Galactic pole is located? Near Sculptor.

For $1,000,000 state the relationship of distance between galaxies, our Sun and the Moon?
Galaxies are several billion miles away. Our Sun is only eight light minutes away. Our Moon is a little over a light second away.

For $1000 state how many digits are needed to write the distances of galaxies? 23.

For $1000 tell the shape of our Galaxy? It is round and flat like a taco.

For $1000 tell what a lunckhod is? A Soviet automatic Moon car driven by radio command from Earth.

For $500 tell how large the Moon is when an eclipse of the Sun occurs? It's new or full.

For $1,000 state where the location of the Moon is when an eclipse of the Sun occurs?
Between the Earth and the Sun.

For $1000 state what a quark is? A quark is a nuclear particle located in neutrons and protrons which scientists have not been able to shake loose yet.

For $5,000 state what Mare Orientale is? Mare Orientale is a circular lunar sea surrounded by ridges and valleys in a succession of rings formed like frozen ripples by the explosion that also formed the sea.

For $500 tell how often there is an eclipse of the Sun? On the Average every 2 or 3 years.

For $1,000 state why our part of our Galaxy is atypical? Because our part of the Galaxy is full of stars.

For $1,000 state how large the diameter of the Moon is compared to the diameter of the Earth? The Moon's diameter is about a quarter the size of the Earth's.

For $1000 state the name of the constellation the direction of the North Galactic Pole is located? Coma Berenices.

For $1000 state how a person can tell the difference between a star and a galaxy when looking at the evening sky? Stars appear circular, compare as dots. Galaxies appear as fuzzy blobs which are not always circular and are far more distant.

For $1,000 give another name for astroids? Mior moons.

For $1000 state how many dwarf novae stars there are? About 200.

For $500 state what a meteor is called when it hits the Earth's surface? Meteorite.

For $1000 tell the name of the largest astroid? Ceres.

For $1000 tell what an equinox is? The moment when the Sun crosses the celestial equator and night and day are equal length.

For $500 state how often comets appear? 5 to 10 times yearly.

For $1000 state what a comet's tail is made of? Gas and dust.

For $1000 state what a comet's head is made of? Ice.

For $500 tell how many degrees there are from the horizon to the zenith point? 90 degrees.

For $1000 state how much weight in our solar system the Sun comprizes? 99%.

For $1000 tell what the degree is at the zenith point looking at the horizon from east to west? 180 degrees.

For $500 tell between which planets most of the astroids travel? Mars and Jupiter.

For $10,000 state how many known pulsating stars there are? About 700.

For $1000 name two metals which meteors are usually made of? Nickel and iron.

For $100 state what a camelopardalis is? A giraffe.

For $100 tell what Thales believed about how the Earth was kept in space? It rested in water.

For $500 tell how many degrees there are in a circle? 360.

For $100 state who Thales was? Ancient Greek astronomer and philosopher.

For $100 state what was the most important idea Galileo's research proved? The Sun is the center of the solar system.

For $100 state where the Earth's crust is thickest? The crust is three times as thick on the ocean floor.

For $100 state where the low velosity area of the Earth is located? In the upper mantle.

For $100 state whether the Earth's core is liquid or solid? The outer core is liquid and the inner core is solid.

For $1000 state where the lithosphere is located? The entire region of the Earth located above the low velosity area.

For $100 state where the mantle of the Earth is located? The region between the crust and the core.

For $100 give another word for the word plates in the Earth's crust? Lithosphere.

For $100 state where the Earth's crust is located? Above the mantle.

For $100 state how the Earth is divided beneath its crust? Into plates.

For $300 name the six largest moons of Saturn? Titan, Rhea, Dione, Tethys and Enceladus.

For $200 name the six largest moons of Uranus? Titania, Oberon, Umbriel, Ariel and Miranda.

For $100 state the definition of aphelion? The point at which an object is the farthest away from the Sun.

For $200 tell what kind of stars have super novas? Red Super Giants.

For $100 tell how many miles the Earth is from the Sun? 93,000,000 miles.

For $100 state the definition of perihelion? The point an object is closest to the Sun.

For $100 state what apogee means? The greatest distance of an object orbiting the Earth.

For $100 state why a spaceship cannot land on Venus? Because its runaway greenhouse effect, the temperature is 475° C. and it would be like landing in a fire.

For $100 give the diameter of the Sun in kilometers? The diameter of the Sun is 700,000 kms.

For $100 give the distance light travels per second? 186,000 miles per/second.

For $100 give the central temperature of the Earth? 4000° C.

For $100 state how much material is lost from the Sun's surface per second? Nearly a million tons.

For $100 give the central temperature of the Sun? 15,000,000° C. and 25,000,000° fahrenheit.

For $100 give the definition of Red Shift? The amount by which the wavelengths of light and other forms of electromagnetic radiation from distant galaxies and quasars are increased because of the expansion of the Universe.

For $100 give the diameter of the Earth in kilometers? The diameter of the Earth is about 12,500 km.

Each time a player lands on the Space Station Message space, the player is compelled to select a card from the top of the face down deck. The indicia will now be described.

For $100 tell how hot Mercury gets in the daytime? 620 degrees fahrenheit.

For $500 tell us why astronauts cannot land on Mercury? Because of its extreme temperatures. It's 700° K. in the daytime and 90° K. at night.

For $100 state the definition of perigee? The point at which an orbiting object is closest to the Earth.

Each time a player lands on Space Station Message, the player is compelled to select a card from the top of the face down deck and follow its directions.

SPACE STATION MESSAGE

Zip to the Moon and mine aluminum there.

For your purchase of a robot, pay World Bank, Inc. $100,000.

Zip to Neried. On your way explore the Veil Nebula.

Flip to Ganymede and help mine the ice and recycle it for the Pharmaceutical Manufacturing Plant there.

You are about to collide with another spaceship. Zone ahead one space.

Haley's Comet is approaching head-on. Zoom back three spaces.

Explore the Owl Nebula on your way to Mars.

Zip to Himalia and set up a systems analysis for monitoring the speed and direction of all spaceships zooming through the Bermuda Triangle.

As a world famous agriculturalist, you have been appointed Director of Agriculture on S26 1980. Zoom there and start one of your magnificent gardens.

Zip to Dine and explore Amata, its largest crater, 240 km in diameter.

Zoom to the Moon and begin mining oxygen-rich rock for the creation of a viable atmosphere at the Space Station located there.

The gage on your fuel tank is low. Zip to S6 1980 for refueling. On your way explore the Pleiades.

Explore the Horsehead Nebula as your spaceship zooms to Europa.

Zoom to Titania and help build the kitchen dining areas.

Zip to Pallas and load the space-cargo-ship with carbonaceous rock.

Zip to Vesta and begin mining the rich iron and nickel deposits on this astroid.

For spaceship repairs, pay World Bank, Inc. $1,000,000 or take a chance on the Black Hole.

Pay World Bank, Inc. $500,000 for refueling your fuel stations.

Zoom to the Moon and assume your position there as director of Water conservation.

Through mental telepathy, you and a spacemate have fallen in love. Zoom to Leda for a rendevous.

Because of your engineering qualifications, you have been selected to mine Gabbro stone on Ceres.

For being the first person to become 140 years old during space voyage, zoom to Alpha Polis for a vacation of twenty years or one turn.

For your space defence systems (deployable and fixed) you have won intergalactic recognition from Legion of Space Defence and $1,000,000 from World Band, Inc. Zip to Miranda to accept your award.

For your imaginative design of a command module, you have won first prize in the Outer Space Art for Practical Use Contest. Zoom to Triton to accept your award.

For your amazing work in network architecture, you have won the Outer Space Communication Award. Zip to Miranda to accept your award.

For your successful mining expedition on Vesta, you have been awarded $10,000 from World Bank, Inc. Zip to Vesta to accept your award.

You have won $5,000,000 on a space lottery ticket. Zip to Charon.

For your laser balistics improvements in outer space patrol, you have been made Governor of Carme. Zip there to assume your new position.

The sparkling galaxies of light in your energy pattern have altered and become dim. Zip to Io for a check-up.

Your astral body has received intelligence of life on Andromeda Galazy. Swish to Andromeda Galaxy.

High frequency photographs of your bioluminescence indicate you need a vacation. Zip to Pluto for a vacation.

In a deep hypnotic trance, you have been told that you were Albert Einstein in your last life. As this genius, you have no limitations. Through telekinesis, zoom to Puck and make a detailed report on the physics of telekineses.

For your published work on mathematical computations and extrasensory perceptions of Galaxy M 31, you have won the Outer Space Psychotronics award. Accept $30,000 from World Bank, Inc. on behalf of this organization.

In a deep hypnotic trance, you have been told that you paint as well as William Basiotes. As this personage, zip to Hyperion and paint all the impressions it makes on you.

You have received a telephathic message that a super nova is about to occur. Zoom to Vesta for safety.

For your indefatigable work on tactical traffic control, you have been made Chief of Outer Traffic Control. Zoom to Titan to assess your new position.

For the best example of exemplary character in your community with the most prized qualities for creative development: frugality, patience, responsibility, initiative, originality and perseverence, please receive the award from the Young Astronauts Program for a free vacation on Portia.

For successfully manning the controls of your spaceship for 75 years, you have won a bonus of $75,000. Zip to Tethys to accept your award.

For exploration of Saturn's moon, Enceladus, you have won $5,000,000,000 from World Bank, Inc. Zip to Enceladus to accept your award.

For bringing five Magellanic Indians safely to Earth for our examination, receive the Outer Space Civil Protection Service award for Alien species.

For your ingenious design of a space sailing vessel, you have been awarded $10,000 from the Outer Space Sailing Club.

For eliminating poverty from the face of the Earth, you have won the Outer Space Peace Award of $1,000,000.00.

For your scientific exploration of Orion Nebula, you have won the Outer Space Explorers Award. Accept the gift of $5,000.

High frequency photographs of your bioluminescence indicates you need a break. Return to Earth and go on a raw vegetable juice diet for three months until your bioluminescence is reinvigorated.

You have been made President of the Outer Space Film Industry. Accept a bonus of $120,000.

For your scientific studies on physiology at zero-g published in the Outer Space Medical Journal, you have been awarded $1000.

For building the best designed Fuel-Cargo-Spaceship, accept an award from World Bank, Inc. of $500,000.

For polluting the atmosphere on your space station, pay World Bank, Inc. a fine of $200,000.

Return to Earth for implantation of transmitters for intergalactic space travel.

For setting up the first outer space factory for home furnishings using materials found in space, you have been named space entrepreneur of the year. Zoom to Callisto to accept your award.

You have been named Chief Engineer of the first mining expedition on Ceres. Zip to that astroid to assume your new position.

As a world famous agriculturalist, you have been appointed Director of Agriculture on J3 1979. Zip there to assume your new position.

Dive to Pluto and explore the perimeter of the Milky Way Galaxy.

Your spaceship and spacesuit that you ordered are ready. Zip to the Manufacturing Plant on Himalia and pick them up.

Your moon buggy is waiting for you at the Motor Vehicle Manufacturing Plant on Leda.

Dance the twist with an alien from the Whirlpool Galaxy in the disco at Shopping Mall S3 1980.

Pay $1,000,000.00 for each lease you won to World Bank, Inc.

Zip to Communication Satellite and unjam the computer.

Your spaceship has tumbled through the Black Hole and landed on Earth.

Your spaceship has tumbled into the Black Hole.

You have been elected Artistic Director of Alpha Polis Theater Company. Collect $1,000,000.00 from World Bank, Inc. before your departure to Alpha Polis.

Each time a player lands on the Communication Satellite, the player is compelled to select a card from the top of the face down deck and follow its directions.

COMMUNICATION SATELLITE

For establishing the first manufacturing plant for pharmaceuticals, you have won $1,000 from the Outer Space Medical Society Society.

Using the dousing method, a divining rod, search for natural resources on astroid, Pallas.

In a deep hypnotic trance, you were told that you write like Anton Checkov. As this personage, go to Desdemona and write your impressions.

For your advances in satellite communications, you have won the Outer Space Communication Satellite Award. Accept a prize of $1000,000 from World Bank, Inc.

For being the first person to become a parent during a space voyage, you have won the Outer Space Fertility Award. Zip to Pluto to accept your award.

For your successful communicaton with intelligent life on Andromeda Galaxy, you have been awarded the Milky Way Peace Award. Zip to Plant X to accept your award.

In a deep hypnotic trance, you have been told you play the piano like Sergel Rachmanioff. Zip to Alpha Polis and give a concert playing Concerto No. 2 in C minor. While there enjoy the use of the following free facilities: lodging, food, refueling your spaceship, repairs to your spaceship, film library, spa and gym, swimming pool, table tennis, theatre, holographic museum, disco and the famous library of the great minds of the universe.

You receive a telepathic message. You realize that you have been reincarnated and thousands of years ago lived on Bianca. Return to the site of your first incarnation.

Zip to Andromeda Galaxy and using ESP convert Andromedian linquistics to Earthling semantics.

Using telekinesis travel to Deimos.

Your scientific experiments in astrophysics are being published in the Astronauts' Journal. Receive $30,000 from the publisher of the Astronauts' Journal.

The members of your spaceship have been hypnotized telepathically by aliens. Return to Mars for debriefing.

Through a deep hypnotic trance you discover that in a past life you were Ghandi. As this personage you no longer desire to manipulate the power of other people for your own neurotic needs, but concentrate on the development of your own power, integrity and strength. Return to Earth and spread your new philosophy.

Your care of plants aboard your spaceship for the last five years has been duly noted by the Outer Space Garden Club. For your caringness you have won the Outer Space Garden Award.

For your advanced studies on Sombrero Galaxy aborigines and decoding their linguistics, receive $10,000 from World Bank, Inc.

For your work you have done in pinpointing UFO's, accept a $25,000 award from World Bank, Inc.

For saving the life of an alien, the Outer Space Medical Society wishes to award you $100,000.

For neglecting to rescue a fellow astronaut when leaving the spaceship to check a disfunction, pay a fine of $1,000,000 to World Bank, Inc.

For your excellent satellite and transmission management, you have won an award from the Outer Space Communication Satellite League. Zip to Oberon to accept your award.

In a deep hypnotic trance, you were told that in your last life you were C. G. Jung. As this personage, you have been selected to go to Ariel and begin studies on the universal subconcious. Zip to Ariel.

Your spaceship is hurtling through the Black Hole. Down, down, down the Black Hole. Are you Alice in Wonderland or the Mad Hatter? Roll the dice. If you get doubles, you zip to Earth through the bottom of the Universe. If you don't, try again til you do unless you've got a release card that'll pull you through.

Zoom to Enceladus and discover the reason this moon has a fault system and may be "living."

Zoom to the nearest Communication Satellite. You have a message waiting on the machine.

For your published work in space physiology and psychological inscapes, you have been elected president of the outer space medical society. Zip to Rosalind.

For repairs made on your spaceship due to a meteorite bombardment, pay World Bank, Inc. $1,000,000.00

Zoom to Andromeda Galaxy and find the Earth-like planet which exists there.

Your water supply is low. Swish to the Water Storage Tank on Juliet and store up.

Zip to Electric Power Plant on Ariel.

Bring your cargo of 300 chickens to the Dairy and Animal Farm on Desdemona.

Zip to Space Station Message. An important message is waiting for you.

For your excellent satellite and transmission management, you have won an award from the Outer Space Communication Improvements Society.

For your capture of space terrorists, you have been made Director of the Space Police Patrol. Accept the award of $50,000.

Zoom to J3 1979 and begin your job as the head of the communications library there.

You are invited to a gala event on Miranda. Swish there for a party of champagne, caviar and pheasant under glass. An alien wants to share your condo with you on Hyperion. Zip there and see if you can make a deal.

You may need to add to your supply of water. Zoom to the Moon and negotiate with the owner if the lease is owned. If unowned, you may buy it.

Spend the weekend with an alien at the Hotel on Sinope.

Don't be surprised if dinosaurs have not died out on another planet in another galaxy. Zip to Shopping Mall S25 1980 and see what's for supper.

Your spaceship is waiting for you at the Spaceship Manufacturing Plant.

You are awarded $1,000 for a shopping spree at the Shopping Mall on Titania. If lease is unowned, you may buy it. If owned, pay owner all costs according to the development of the lease.

As a qualified veterianarian, you are requested to visit the Dairy and Animal Farm on Elars. The cows are suffering from some unusual virus and need your attention.

You have been made supervisor of the Manufacturing Plant on Leda. Whirl there to assume your new position.

For successfully decoding morse code messages from the Whirlpool Galaxy, accept an award of $50,000 from the Intergalactic Linquistic Society.

Zoom to Lysithea and set up a systems analysis for monitoring the speed of spaceships zooming through the Bermuda Triangle.

Zoom to Ceres and begin mining diamonds there.

For causing dissension among your fellow spacemates through your propensity for vicious gossip, pay World Bank, Inc. $300,000.

For designing and overseeing the construction of the first outer space golf course on Phoebe, you have won $100,000 from the Outer Space Architectural Society.

Zoom to Pallas and establish the first iron mine there.

For being the first person to have septuplets in outer space, you have won the Outer Space Fertility Award and $25,000 from World Bank, In.

Explore the Dumbbell Nebula on your way to Iapetus.

You have a message on the Space Station Message machine. Zip to the nearest Space Station Message Service to receive your call.

In a deep hypnotic trance you discover in a past life you were an Egyptian priest with great healing powers. Put those healing powers to use and zoom to Earth and cure the people suffering from a plague there.

Mountain climb on Umbriel.

For the invention of solar energy plants throughout the solar system and for use on Earth, accept the Outer Space Conservation of Fossil Fuel Award and the Clean Air Award of $100,000.

Whish to Titan. As it has a nitrogen-rich atmosphere like Earth, see if those seedlings you have brought from Russia, Greenland and Alaska will sprout.

The gage on your fuel tank is low. Zip to Bianca for refueling. If lease is unowned, you may buy it. If owned, pay owner all costs according to the terms of the lease.

For the spacey meal prepared for you invisible and luminous with energy powers to transport your bioluminosity throughout the solar system and to Andromeda Galaxy and back, pay the owner of Spaceport Cressida $500,00.

For secretly creating a super-agressive, ruthless species of tyranising, warlike dinosaurman on Space Station Puck, pay owner of this property $200,000 for violations of the lease.

For your enjoyment of the luminous, holographic, zero-g swimming pool at Spaceport Portia, pay owner of lease $600.00.

For luscious tomatoes and corn you grow in the agriculture dome on Space Station Ophelia, you win $1,000 prize for the best produce at the Space Station Fair.

For your afternoons exercise jogging and playing table tennis, using the swimming pool and sauna at the Spa and Gym on the Shopping Mall titania, pay owner of lease $100.00.

For creating the first American Manufacturing Plant for the making of bricks from solid waste from your sewage plant instead of dumping solid waste into the ocean, collect $1,000,000, from World Bank, Inc.

For establishing the first tank for the recycling of garbage and turning it into alcohol to be used as fuel for cars and thereby stemming the garbage disposal problem, and save on fossil fuel and pollution as well, collect $1,000,000. From World Bank, Inc.

Each time a player lands on SPACE STATION MESSAGE, the player is compelled to select a card from the top of the face down deck and follow its directions. Herein are the remaining cards in this deck described.

SPACE STATION MESSAGE

For syphoning oil without permission, pay owner of Fuel Station Umbriel $300.00.

Pitch to Cordelia and start building a swimming pool for the recreation facility.

For using more than your share of electricity, pay owner of Electric Power Plant, Ariel $400.00.

You have been made supervisor of Condominium Titania. Zip to Titania to assume your position.

For misappropriating towels, bathmat, lamp and three ashtrays, pay owner of Hotel Miranda $300.00.

For poaching chickens on Dairy and Animal Farm, Desdemona, pay owner $500.00.

For watering your courtyard on Condominium Cordelia after kerfew, pay owner $400.00.

Each time a player lands on Communication Satellite Message, they must select a card from the top of the face down deck and follow its directions. Herein are the remaining cards described called Communication Satellite Message Cards. Using telekinesis and laser beams, your spaceship has been released from the Black Hole.

Ganymede is the only other celestial body other than Earth with lateral faulting. Osillate to Ganymede and check out this face to see if it is possible to create an Earth-like atmosphere on Ganymede.

Zip to J1 1979 to photograph the perimeter of Jupiter.

Levitate to J2 1979 and begin your new job as the head of the telecommunications library there.

Circle the Enke Doodle Ring of Saturn before you land on S 26 1980. Because of your architectural expertise, you have been appointed to build a tennis court here for recreational center.

For your taxie ride from the Space Shuttle to Mars, pay World Bank, Inc. $200.00.

TABLE 1

| OBERON LEASE FOR ELECTRIC POWER PLANT | |
|---|---|
| Price for purchase of Lease | $1,000.000. |
| If 1 electric power plant is owned pay 1 times the amount of the price of the Lease. | |
| If 2 electric power plants are owned pay 2 times the price of the Lease. | |
| If 3 electric power plants are owned pay 3 times the price of the Lease. | |
| If 4 electric power plants are owned pay 4 times the price of the Lease. | |
| If 5 electric power plants are owned pay 5 times the price of the Lease. | |
| If 6 electric power plants are owned pay 6 times the price of the Lease. | |
| If 7 electric power plants are owned pay 7 times the price of the Lease. | |

If Lease has not been purchased from World Bank, Inc., pay $200 for electrical service.
If a player owns all the Electric Power Plants, they may double the price of electrical power service.
Players may mortgage their electrical power plants at half price to World Bank, Inc.
Each Electric Power Plant costs $500,000.

TABLE 2

| PUCK | |
|---|---|
| LEASE FOR SPACE STATION | |
| Price of Lease | $9,200,000. |
| Docking fee to World Bank, Inc. before purchase of Lease | $2,000. |
| Docking fee before development of Lease | $2,500. |
| RENT UPON DEVELOPMENT | |
| WITH FUEL STATION | $3,900,000. |
| WITH AGRICULTURE DOME | $10,000,000. |

TABLE 2-continued

| PUCK | |
|---|---|
| WITH HOUSING DOME | $14,900,000. |
| WITH COMMUNICATION SATELLITE | $27,000,000. |
| WITH TELESCOPE | $30,500,000. |
| WITH LASER BEAM STATION | $33,200,000. |

When purchasing property, a player or corporation of players must follow the order of development listed on the lease.
To get the price of each game piece, multiply a throw of the dice by $6,000.
If a player owns all the space stations in the same color coded zone, they may double the rent according to the development of the Lease.
Players may mortgage their property at half price to World Bank, Inc.

TABLE 3

| PORTIA | |
|---|---|
| LEASE FOR SPACEPORT (VACATION RESORT) | |
| Price of Lease | $15,500,000. |
| Docking fee to world Bank, Inc. before purchase of Lease | $8,500. |
| Docking fee before development of Lease | $9,500. |
| RENT UPON DEVELOPMENT | |
| WITH MOTEL | $7,000,000. |
| WITH SWIMMING POOL | $16,500,000. |
| WITH RESTAURANT | $28,500,000. |
| WITH FUEL STATION | $38,000,000. |
| WITH GARAGE | $39,000,000. |

When purchasing property, a player or corporation of players must follow the order listed on the Lease.
To get the price of each game piece, multiply a throw of the dice by $11,000.
If a player owns all the Spaceports, they may double the rent according to the development of the Lease.
Players may mortgage their property at half price to World Bank, Inc.

TABLE 4

| GANYMEDE | |
|---|---|
| LEASE FOR MANUFACTURING PLANT | |
| Food and Pharmaceuticals. | |
| Price of Lease | $10,000,000. |
| Docking fee to World Bank, Inc. before purchase of Lease | $0,004,000. |
| Docking fee before development of Lease | $0,004,500. |
| RENT UPON DEVELOPMENT | |
| WITH MACHINERY AND SUPPLIES | $3,000,000. |
| WITH 100 WORKERS | $12,000,000. |
| WITH 200 WORKERS | $24,000,000. |
| WITH 300 WORKERS | $36,000,000. |

When purchasing property or hiring employees, a player or corporation of players must follow the order of development listed on the lease.
If a player owns all the Manufacturing plants, they may double the rent according to the development of the Lease.
To get the price of each game piece, multiply a throw of the dice by $7,000.
Players may mortgage their property at half price and fire employees at half salary to Woorld Bank, Inc.

TABLE 5

| SINOPE | |
|---|---|
| LEASE FOR HOTEL | |
| Price of Lease | $13,000,000. |

TABLE 5-continued

| SINOPE | |
|---|---|
| Docking fee to World Bank, Inc. before purchase of Lease | $6,000. |
| Docking fee before development of Lease | $6,500. |
| RENT UPON DEVELOPMENT | |
| WITH 100 ROOMS | $5,000,000. |
| WITH 200 ROOMS | $14,000,000. |
| WITH 300 ROOMS | $26,000,000. |
| WITH 400 ROOMS | $36,000,000. |

When purchasing property, a player or corporation of players must follow the order listed on the Lease.
To get the price of each game piece, multiply a throw of the dice by $9,000.
If a player owns all the hotels, they may double the rent according to the development of the Lease.
Players may mortgage their property at half price to World Bank, Inc.

TABLE 6

| TITANIA | |
|---|---|
| LEASE FOR SHOPPING MALL | |
| Price of Lease | $19,600,000. |
| Docking fee to World Bank, Inc. before purchase of Lease | $13,000. |
| RENT UPON DEVELOPMENT | |
| WITH DISCO | $10,000,000. |
| WITH PIZZA PARLOUR | $19,500,000. |
| WITH SPA AND GYM | $31,500,000. |
| WITH BOUTIQUE | $42,000,000. |
| WITH VIDEO ROOM | $42,500,000. |
| WITH CHAIN FOOD STORE | $43,500,000. |
| WITH FUEL STATION | $44,000,000. |
| WITH GARAGE | $44,500,000. |

When purchasing property, a player or corporation of players must follow the order listed on the lease.
To get the price of each game piece, multiply a throw of the dice by $13,500.
If a player owns all the Shopping Malls, they may double the price according to the development of the Lease.
Players may mortgage their property at half price to World Bank, Inc.

TABLE 7

| CORDELIA | |
|---|---|
| LEASE FOR CONDOMINIUM | |
| Price of Lease | $7,800,000. |
| Docking fee to World Bank, Inc. before purchase of Lease | $500. |
| Docking fee upon purchase of Lease | $800. |
| RENT UPON DEVELOPMENT | |
| WITH TEN APARTMENTS | $6,500,000. |
| WITH TWENTY APARTMENTS | $7,000,000. |
| WITH THIRTY APARTMENTS | $8,000,000. |
| WITH FORTY APARTMENTS | $9,000,000. |

When purchasing property, a player or corporation of players must follow the order listed on the lease.
To get the price of each game piece, multiply a throw of the dice by $4,000,000.
If a player owns all the Condominiums, they may double the rent according to the development of the Lease.
Players may mortgage their property at half price to World Bank, Inc.

TABLE 8

| PALLAS | |
|---|---|
| MINING SITE | |
| Price of Lease | $6,000,000. |
| Docking fee to World Bank, Inc. before purchase of lease | $0,000,900. |
| Docking fee before development of Lease | $0,001,000. |
| RENT UPON DEVELOPMENT | |
| WITH MASS DRIVER | $1,000,000. |
| WITH SUPER CONDUCTRO RAILS | $2,000,000. |
| WITH RAIL CARS | $3,000,000. |

TABLE 8-continued

| PALLAS | |
|---|---|
| WITH POWER PLANT | $4,000,000. |

When purchasing property, a player or corporation of players must follow the order of development listed on the lease.
To get the price of each game piece, multiply a throw of the dice by $1,000.00.
If a player owns all the Mining Sites, they may double the rent according to the development of the lease.
Players may not develop mining sites unless they own all three leases.
Players may mortgage their property at half price to World Bank, Inc.

TABLE 9

| DESDEMONA | |
|---|---|
| DAIRY AND ANIMAL FARM | |
| Price of Lease | $6,000,000. |
| Docking fee to World Bank, Inc. before purchase of Lease | $100. |
| Docking fee before development of Lease | $400. |
| RENT UPON DEVELOPMENT | |
| WITH BARN | $2,000. |
| WITH SILO | $3,100. |
| WITH CHICKENS | $4,500. |
| WITH COWS | $9,800. |

to find the price of each game piece for development, multiply a roll of the dice by $3,000.
In developing the Lease, a player must follow the order listed on the Lease.
If a player owns all the farm leases regardless of color-coded zone of location, they may double the rent according to the development of the lease.
Players may mortgage their property at half price to World Bank, Inc.

TABLE 10

| ROSALIND LEASE FOR FUEL STATION | |
|---|---|
| Price for purchase of Lease | $5,000,000. |
| Price for refueling of spaceships upon purchase of Lease | $1,200. |
| If a player owns 2 fuel stations pay | $1,300. |
| If a player owns 3 fuel stations pay | $1,400. |
| If a player owns 4 fuel stations pay | $1,500. |
| If a player owns 5 fuel stations pay | $1,600. |
| If a player owns 6 fuel stations pay | $1,700. |
| If a player owns 7 fuel stations pay | $1,800. |
| If a player owns 8 fuel stations pay | $1,900. |
| If a player owns 9 fuel stations pay | $2,000. |

If Lease has not been purchased from World Bank, Inc., pay World Bank, Inc. $1,000. for refueling your spaceship.
If all the fuel stations are owned by the same player, they may double the price of fuel.
Each Fuel Station costs $1,000.
Players may mortgage their fuel stations at half price to World Bank, Inc.

TABLE 11

| JULIET | |
|---|---|
| LEASE FOR WATER STORAGE TANK | |
| Price of Lease | $2,000,000. |
| WATER BILL FOR DOCKING SPACESHIPS | |
| If 1 water storage tank in owned pay | $500. |
| If 2 water storage tanks are owned pay | $600. |
| If 3 water storage tanks are owned pay | $700. |
| If 4 water storage tanks are owned pay | $800. |

If Lease has not been purchased from World Bank, Inc., pay $300 for your water supplies.
If a player owns all the Water Storage Tanks, they may double the price for water supplies.
Players may mortgage their water storage tanks at half price to World Bank, Inc.
Each Water Storage Tank costs $800.

I claim:

1. A board game apparatus comprising:

a board having marked thereon a playing path divided into a plurality of spaces;

a plurality of playing pieces for indicating the position of each player;

a random number generating means for randomly determining the movement of said playing pieces along said path;

a plurality of play money;

said path comprising a plurality of purchaseable property spaces;

a plurality of lease cards one for each of said purchaseable property spaces for indicating ownership a set of cards, each card being distinguishable by having one of plurality of different indicia;

said path further comprising unpurchaseable spaces, each distinguishable by having one of said different indicia;

an instruction card having marked thereon all of said different indicia and having a corresponding monetary amount marked next to each indicia for indicating the amount of money a player must pay wherein the winner is the players with the most currency and/or property value.

2. The board game apparatus of claim 1 further comprising:

a plurality of question cards;

said path further comprising question spaces directing a player landing thereon to select a question card and answer the question.

3. The board game apparatus of claim 1 further comprising:

second and third sets of instruction cards, each card directing a player to pay a fee after moving to a certain space on the board;

said path further comprising a second and third sets of spaces, each respectively having second and third indicia to correspond to said second and third sets of instruction cards for directing a player landing on one of said second or third sets of spaces to select a corresponding card.

4. The board game apparatus of claim 1 wherein each of said lease cards having indicia listing a plurality of different property improvements for each property;

developing means comprising a plurality of development tokens, each token corresponding to one of said property improvements, said tokens having engagement means and said purchaseable property spaces each having a plurality of receiving means for receiving said engagement means such that each of said purchaseable property spaces is capable of securely supporting a plurality of development tokens for continued development of said purchaseable property spaces; said engagement means are prongs and said receiving means are holes for receiving the prongs.

* * * * *

UNITED STATES PATENT AND TRADEMARK OFFICE

CERTIFICATE OF CORRECTION

PATENT NO. : 4,946,169
DATED : August 7, 1990
INVENTOR(S) : Elsa O. Hofmann

It is certified that error appears in the above-identified patent and that said Letters Patent is hereby corrected as shown below:

Column 23,
Line 7, change “lease” to read -- property --.

Signed and Sealed this

Eighteenth Day of February, 2003

JAMES E. ROGAN
*Director of the United States Patent and Trademark Office*